United States Patent [19]

Kimijima et al.

[11] Patent Number: 4,623,310

[45] Date of Patent: Nov. 18, 1986

[54] VAPORIZED LIQUID FUEL COMBUSTION APPARATUS

[75] Inventors: Yoshiaki Kimijima, Yaita; Kunio Kikuchi, Odawara, both of Japan

[73] Assignee: Mikuni Kogyo Kabushiki Kaisha, Tokyo, Japan

[21] Appl. No.: 727,004

[22] Filed: Apr. 24, 1985

[51] Int. Cl.[4] ..... F23Q 3/00

[52] U.S. Cl. ..... 431/261; 126/110 B; 431/262

[58] Field of Search ..... 431/158, 173, 260, 261, 431/262; 126/110 B, 116 R; 237/12.3 C

[56] References Cited

U.S. PATENT DOCUMENTS

| | | | |
|---|---|---|---|
| 2,779,398 | 1/1957 | Brown | 431/262 |
| 3,086,579 | 4/1963 | Brown | 431/262 |
| 3,174,277 | 3/1965 | Hettich | 237/12.3 C X |
| 3,543,742 | 12/1970 | Stump | 126/110 B |
| 3,779,229 | 12/1973 | Volbehr | 126/110 B |
| 3,894,526 | 7/1975 | Kofink | 126/110 B |
| 3,989,029 | 11/1976 | Friedl et al. | 126/110 B |
| 3,989,030 | 11/1976 | Friedl | 126/110 R |
| 4,216,759 | 8/1980 | Friedl et al. | 126/110 B |
| 4,471,754 | 9/1984 | Galtz | 126/110 B |
| 4,519,375 | 5/1985 | Galtz | 126/110 B |
| 4,530,658 | 7/1985 | Panick | 237/12.3 C X |

*Primary Examiner*—Margaret A. Focarino

*Attorney, Agent, or Firm*—Pahl, Lorusso & Loud

[57] ABSTRACT

An improved vaporized liquid fuel combustion apparatus of the type including a cylindrical combustion chamber, a blower, and end plate located between the combustion chamber and the blower and a heat exchanger for heating air by utilizing thermal energy generated in the combustion chamber is disclosed. The combustion chamber, the blower, the end plate and the heat exchanger are separable components and the blower and the heat exchanger are firmly assembled together by tightening bolts at a single flange connection with the end of the combustion chamber making gastight contact with the peripheral end part of the end plate. The one end part of the combustion chamber, the peripheral end part of the end plate are formed and the one end part of the heat exchanger are formed to mate together. Both the one end part of the combustion chamber and the peripheral end part of the end plate are formed with a plurality of holes through which bolts are inserted and the one end part of the heat exchanger is formed with a plurality of female thread holes into which the bolts are threadably engaged.

5 Claims, 3 Drawing Figures

VAPORIZED LIQUID FUEL COMBUSTION APPARATUS

BACKGROUND OF THE INVENTION

1. Field of the Invention

The present invention relates to a vaporized liquid fuel combustion apparatus and more particularly to improvement of or relating to a vaporized liquid fuel combustion apparatus of the type including a cylindrical combustion chamber, a blower, an end plate located between the combustion chamber and the blower and a heat exchanger for heating fluid by utilizing thermal energy generated in the combustion chamber.

2. Description of the Prior Art

To facilitate understanding of the present invention it will be helpful that a typical conventional vaporized fuel combustion apparatus of the above-mentioned type is described below with reference to FIG. 1.

As illustrated in the drawing, the combustion chamber 10 is formed in a cylindrical configuration and includes an end plate 12 at the downstream end, an end plate 14 at the upstream end and a flame orifice 16 located in the middle part thereof each of which is fixedly secured to the combustion chamber 10 by welding. The upstream end plate 14 is formed with an air inlet port 17 through which combustion air is introduced into the combustion chamber 10 and moreover includes a shielding plate 18 which serves to inhibit combustion air from flowing straight without any hindrance encountered. Since the shielding plate 18 is exposed to the elevated temperature of combustion gas during operation of the apparatus, it is a component which deteriorates within a very short period of time. A heat exchanger 20 having an annular air passage is fixedly secured to the outer periphery of the cylindrical combustion chamber 10 by welding. Further, the combustion chamber 10 has an ignition plug mounting sleeve 24 fixedly secured thereto by welding so that an ignition plug 22 is threadably mounted on the ignition plug mounting sleeve 24. The inner wall of the ignition plug mounting sleeve 24 is lined with a layer of firing wick 28 which absorbs liquid fuel delivered via a fuel pipe 26 to maintain the flame in the combustion chamber. The firing wick 28 is one of the components which deteriorate within a short period of time and, therefore, must often be replaced with a new one.

An air introducing apparatus for introducing combustion air into the combustion chamber 10 essentially comprises a casing 32, a motor 34 and a rotor 36 driven by the motor 34. The casing 32 is formed with an air duction port 38 and a discharge port 40. As the rotor 36 is rotated, air is discharged from the air discharge port 40 to be introduced into the combustion chamber 10 through an air inlet port 17 on the upstream end plate 14. Combustion gas generated in the combustion chamber 10 enters the heat exchanger 20 via a communication passage 42 and it is then discharged to the outside via a discharging pipe 44 which is connected to the outer wall of the heat exchanger 20.

On the other hand, the motor 34 is operatively connected to a blower fan 46 for supplying air to be heated and air to be heated flows along the inner wall of a cover 48 in the direction as identified by double-lined arrow marks in the drawing.

As is apparent from the drawing, the combustion chamber 10 is made integral with the heat exchanger by welding and the end plate 14 with a combustion inlet port formed thereon is fixedly secured to the upstream end of the combustion chamber 10 by welding. (It should be noted that the conventional vaporized liquid fuel combustion apparatus as constructed in the above-described manner is disclosed, for instance, in Japanese Publication Patent No. 5685/1962.) The arrangement of the conventional apparatus made in that way makes it impossible to replace an individual component, for instance, shielding plate 18 with a new one or to repair it when it deteriorates under the influence of elevated temperature. Accordingly, a drawback of the conventional apparatus is that the service life of the combustion chamber 10 and the heat exchanger 20 is limited by the service life of components which deterisrate within a short period of time. Another drawback is that manufacturing of the conventional apparatus requires many man-hours for performing welding due to the fact that the combustion chamber is made integral with the heat exchanger by welding. As a result, the apparatus is manufactured at an expensive cost. Further, since the apparatus is constructed such that the combustion chamber 10 is fixedly secured to the one side of the casing and the support plate 49 for the motor 34 is fixedly secured to the other side of the same, it requires many man-hours for assembly, resulting in increased manufacturing cost.

SUMMARY OF THE INVENTION

Thus, the present invention has been made with the foregoing background in mind and its object resides in providing an improved vaporized liquid fuel combustion apparatus which assures that inspecting and repairing of the combustion chamber as well as replacing of deteriorated components with new ones are achieved easily.

Another object of the present invention is to provide an improved vaporized liquid fuel combustion apparatus which requires a reduced number of man-hours for welding and assembling operations.

Another object of the present invention is to provide an improved vaporized liquid fuel combustion apparatus which assures a long service life of the combustion chamber and the heat exchanger.

To accomplish the above objects there is provided according to the present invention a vaporized liquid fuel combustion apparatus of the type including a cylindrical combustion chamber for generating combustion gas by burning vaporized liquid fuel therein, an air blower for feeding combustion air into the cylindrical combustion chamber, an end plate with a shielding plate fixedly secured thereto and spaced therefrom for inhibiting combustion air from flowing straight without any hindrance and a heat exchanger for transfer of thermal energy from the combustion gas to a fluid to be heated, wherein the improvement consists in that the cylindrical combustion chamber, the blower, the end plate and the heat exchanger are provided as separate components and that the blower and the heat exchanger are assembled together with the aid of removable securing means and the one end part of the cylindrical combustion chamber comes in gastight contact with the peripheral end part of the end plate.

The one end part of the combustion chamber is gastightly clamped between the blower and the heat exchanger. Preferably, the one end part of the cylindrical combustion chamber and the peripheral end part of the end plate are so formed that mate together.

Further, the one end part of the cylindrical combustion chamber and the one end part of the heat exchanger are so formed that they also mate together.

Other objects, features and advantages of the invention will become more clearly apparent from a reading of the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENT

Now, the present invention will be described in a greater detail hereunder with reference to the accompanying drawings which schematically illustrate a preferred embodiment thereof.

Figure 1:
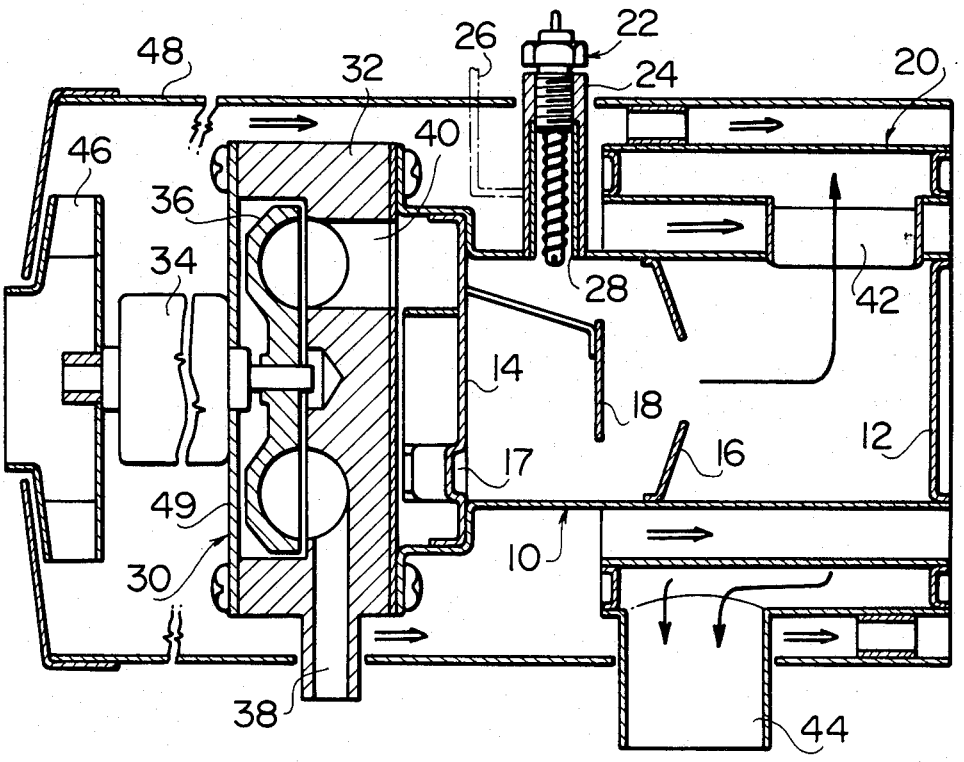
FIG. 1 (PRIOR ART)
FIG. 1 is a schematic sectional view of a typical conventional vaporized liquid fuel combustion apparatus.
Figure 3:
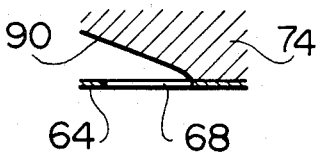
FIG. 3 is fragmental sectional view of the apparatus taken along line I—I in FIG. 2.
Figure 2:
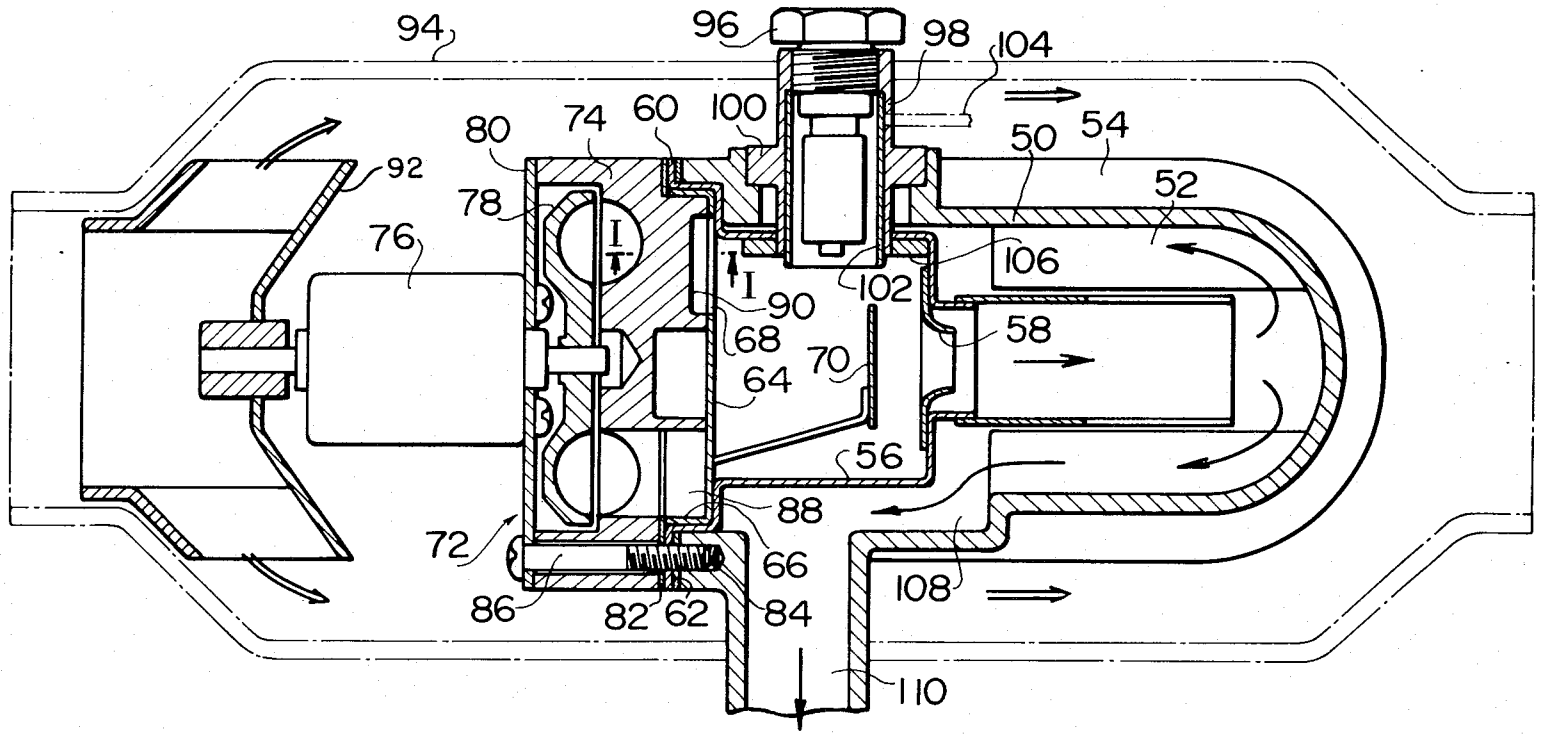
FIG. 2 is a schematic sectional view of a vaporized liquid fuel combustion apparatus in accordance with an embodiment of the invention.

As illustrated in FIGS. 2 and 3, the apparatus of the invention includes a cylindrical heat exchanger 50 having an open upstream end and a closed downstream end. The heat exchanger 50 is formed with a plurality of heat absorbing fins 52 around the inner peripheral wall as well as a plurality of heat radiating fins 54 around the outer peripheral wall thereof. A cylindrical member 56 defining a combustion chamber is arranged separately from the heat exchanger 50 and includes a larger diameter portion on the upstream side and a smaller diameter portion on the downstream side thereof. Further, the larger diameter portion of the cylindrical member 56 is closed at its downstream end by means defining a central orifice 58 and moreover includes, at its upstream end, a flange 60 having a cylindrical portion and a radially extending portion. When the cylindrical combustion chamber 56 is assembled with the heat exchanger 50 by inserting the former into the latter, a sheet of packing 62 is interposed between the flange 60 and the open end face of the heat exchanger 50 for the purpose of inhibiting leakage.

As is apparent from FIG. 2, an end plate 64 located at the upstream end of the cylindrical combustion chamber 56 is made separate from the latter and includes a skirt 66 around its outer periphery which is adapted to be fitted into the cylindrical portion of the flange 60 of the combustion chamber 56. The end plate 64 is formed with a single combustion air inlet port 68 and moreover includes a shielding plate 70 which is located in the larger diameter portion of the combustion chamber 56, the shielding plate 70 being intended to inhibit combustion air introduced through the inlet port 68 from flowing straight toward the downstream of the combustion chamber 56.

An air blower 72 for introducing combustion air into the cylindrical combustion chamber 56 essentially includes a casing 74, a motor 76 and a rotor 78 which is driven by the motor 76. The latter is fixedly secured to a support plate 80. The support plate 80, the casing 74, the packing 62, the flange 60 of the cylindrical combustion chamber 56 and the packing 82 interposed between the flange 60 and the casing 74 are formed with a plurality of through holes respectively through which bolts 86 are inserted. On the other hand, the heat exchanger 50 is formed with the same number of female alignable the aforesaid through holes 84. The support plate 80, the casing 74, the packing 82, the flange 60 and the packing 62 are fixed to the heat exchanger 56 by threadably engaging the bolts 86 into the female thread holes 84.

An annular groove 88 is formed in the area located on the left side of the end plate 64 as seen in the drawing so as to guide the flow of combustion air toward the inlet port 68 on the end plate 64. As illustrated in FIG. 3, the annular groove 88 is designed such that its depth as measured from the bottom 90 gradually decreases toward the inlet port 68. By virtue of designing of the annular groove 88 in that way, combustion air which has been introduced into the annular groove 88 can be delivered into the interior of the cylindrical combustion chamber 56 through the inlet port 68 in the form of a swirling flow.

The motor 76 is operatively connected to a blower fan 92 by means of which air to be heated is delivered toward the heat exchanger 50 along the inner wall surface of a cover 94, as indicated by double-lined arrow marks in the drawing.

An ignition plug mounting sleeve 98 with an ignition plug 96 threadably mounted thereon is detachably fitted to the heat exchanger 50. The ignition plug mounting sleeve 98 has an integral larger diameter portion 100 and the larger diameter portion 100 is fixedly secured to the heat exchanger 50 by means of a plurality of bolts which are not shown in the drawing. The inner wall of the ignition plug mounting plug 98 is lined with a layer of firing wick 102 which serves to absorb therein liquid fuel which is delivered via a fuel pipe 104 in order to supply fuel to the combustion chamber.

Further, another layer of firing wick 106 is disposed inside the larger diameter portion of the combustion chamber cylinder 56 at the position in the proximity of the lowermost end of the ignition plug mounting sleeve 98 in order to facilitate the starting of burning and to stabilize the burnt state in the combustion chamber 56.

Assembling of the vaporized liquid fuel combustion apparatus of the invention as constructed in the above-described manner is carried out by way of the following steps.

First, the end plate 64 is fitted into the cylindrical portion of the flange 60 at the upstream end of the cylindrical combustion chamber 56 and the latter is then inserted into the heat exchanger 50 with a sheet of packing 62 interposed therebetween. Next, the casing 74 is attached to the end plate 64 with a sheet of packing 82 interposed therebetween. Thus, by threadably engaging bolts 86 into female thread holes 84 on the end face of the heat exchanger 50, the motor support plate 80, the casing 74 and the end plate 64 are gas-tightly secured to the heat exchanger 50. Thereafter, the ignition plug mounting sleeve 98 is mounted onto the heat exchanger 50 and the ignition plug 96 is then threadably engaged to the ignition plug mounting sleeve 98.

Next, operation of the liquid fuel combustion apparatus thus assembled by way of the steps as described above will be described below.

When the ignition plug 96 is turned on and the layer of firing wick 102 is supplied with fuel, the latter is heated up until ignition takes place and burning fire is developed. As the rotor 78 of the air blower is rotated and combustion air is introduced into the cylindrical combustion chamber 56, fuel combustion is initiated and thereby temperature in the cylindrical combustion chamber 56 is raised up to such a sufficiently high level that ignition plug 96 is no longer necessary for the purpose of maintaining the combustion.

Combustion gas thus produced in the cylindrical combustion chamber 56 flows through the smaller diameter portion in the direction as indicated by an arrow mark in the drawing and it is then caused to reverse flow at the downstream end thereof. Thereafter, it flows further through the annular passage 108 as defined between the heat exchanger 50 and the cylindrical combustion chamber 56 until it is discharged to the outside via an exhaust pipe 110.

On the other hand, air to be heated flows along the inner wall of the cover 94 in the direction as by double-lined arrow marks in the drawing to receive thermal energy from combustion gas by way of the heat exchanger 50.

Advantageous features of the vaporized liquid fuel combustion apparatus of the invention will be noted below.

(1) In the event that some component constituting the apparatus, for instance shielding plate 70, becomes deteriorated replacement of the deteriorated component with a new one or repairing of the same can be easily achieved. As a result, the running life of the cylindrical combustion chamber 56 and other components can be practically elongated without reduction of the excellent performance of the apparatus.

(2) Unburnt carbon deposited on the inner wall of the cylindrical combustion chamber 56 can be easily removed therefrom.

(3) Man-hours required for manufacturing the apparatus inclusive man-hours for carrying out welding and assembling operations can be substantially reduced. Moreover, operations for manufacturing the apparatus can be performed easily. As a result, the apparatus can be manufactured at an inexpensive cost.

(4) By virtue of the arrangement that the end plate can be disconnected from the cylindrical combustion chamber so as to allow it to be replaced with new one, combustion of vaporized fuel can be easily initiated in the area located around the ignition plug mounting sleeve 98 as well as in the cylindrical combustion chamber 56. Moreover, fitting of the firing wick 106 to the inner wall of the combustion chamber can be achieved without particular difficulty.

While the present invention has been described above with respect to a single preferred embodiment, it should of course be understood that it should not be limited only to this but various changes or modifications may be made in any acceptable manner without departure from the spirit and scope of the invention as defined by the appended claims.

What is claimed is:

1. A vaporized liquid fuel combustion apparatus comprising:

a cylinder defining a combustion chamber, said cylinder having an inlet end for receipt of combustion air, a first flange surrounding said inlet end and an outlet end for exhausting gaseous combustion products;

means for introducing the fuel into said combustion chamber and ignition means exposed to said combustion chamber through said cylinder;

an end plate at least partially covering said inlet end of said cylinder and defining an opening for the admission of combustion air into said combustion chamber, said end plate having a second flange surrounding its periphery, said second flange mating with said first flange;

a cylindrical heat exhanger for indirect heat exchange between the combustion products and a fluid to be heated, said heat exchanger surrounding said outlet end of said cylinder and having a third flange at one end thereof, said third flange mating with said first and second flanges;

a blower for feeding air to said combustion chamber, said blower having an end portion contoured to mate with said first, second and third flanges; and means for detachably securing said first, second and third flanges and said blower end portion together to form a single gaslight flanged joint, said cylinder, blower end plate and heat exchanger being separable components secured together only at said single flanged joint.

2. A combustion apparatus in accordance with claim 1 wherein said first, second and third flanges each define cylindrical portions which nest one within the other and mate with said blower end portion.

3. An apparatus in accordance with claim 1 wherein said heat exchanger has a closed end opposite its flanged end and further has a plurality of heat exchange fins extending radially outward from its cylindrical surface.

4. A combustion apparatus in accordance with claim 1 further comprising a shielding plate mounted within said combustion chamber parallel to said end plate for deflecting the flow of combustion air through said combustion chamber.

5. A combustion apparatus in accordance with claim 1 further ocmprising a flame tube fixed to the outlet end of said cylinder and of a smaller diameter than said cylinder.

* * * * *